US005333430A

United States Patent [19]

Vidal

[11] Patent Number: 5,333,430

[45] Date of Patent: Aug. 2, 1994

[54] PAVING AND WALL TILE

[76] Inventor: Francisco J. L. Vidal, Urgell, 237, 08036 Barcelona, Spain

[21] Appl. No.: 998,521

[22] Filed: Dec. 30, 1992

[30] Foreign Application Priority Data

Dec. 31, 1991 [ES] Spain ..... 9103954

[51] Int. Cl.[5] ..... E04C 2/30; E04F 13/08

[52] U.S. Cl. ..... 52/311.2; 52/390; 404/42; D25/138

[58] Field of Search ..... 52/390, 392, 574, 575, 52/604, 102, 311.1, 311.2, 589, 590; 404/34, 41, 42; D25/112, 113, 138

[56] References Cited

U.S. PATENT DOCUMENTS

| | | | |
|---|---|---|---|
| 599,117 | 2/1898 | Broome et al. | 52/575 |
| 4,674,245 | 6/1987 | Turner | 52/177 |
| 5,211,692 | 5/1993 | Lalvani | 52/311.2 |

FOREIGN PATENT DOCUMENTS

| | | | |
|---|---|---|---|
| 0287747 | 4/1987 | European Pat. Off. . | |
| 1534350 | 10/1966 | Fed. Rep. of Germany . | |
| 941261 | 1/1949 | France | 52/574 |
| 2307083 | 4/1976 | France . | |
| 656162 | 10/1981 | Switzerland . | |

*Primary Examiner*—Michael Safavi
*Attorney, Agent, or Firm*—McGlew and Tuttle

[57] ABSTRACT

A tile for paving and floor and wall covering comprises a substantially flat body with a polygonal periphery with plural recess and different parallel sides opposite to one another. The tile is juxtaposed by fitting it together with identical tiles in a first orientation to completely cover a surface or a second orientation to define free spaces of substantially identical size and width. The orientation is selectively preestablished according to tile sides to be joined.

9 Claims, 1 Drawing Sheet

PAVING AND WALL TILE

FIELD OF THE INVENTION

The object of this utility model pertains to a tile that has a versatility that similar tiles do not have and is particularly advantageous, because of its carefully designed configuration, as it can be used both for paving tiles and for wall tiles.

SUMMARY AND OBJECTS OF THE INVENTION

Essentially, this tile consists of a polygonal body, which is not very thick, with a series of recesses and breaks on the periphery that permit it to be joined to the other identical tiles and to leave intermittent open spaces suitable for accommodating plants or grass and protecting them from being crushed in the case of paving; in the case of walls, such as in bathrooms, the same tile can be joined to other identical tiles continuously, in other words, without leaving any open space between them.

In order to facilitate the description, attached to this specification is a page of drawings illustrating a practical embodiment which is given only as an example that in no way limits the scope of this utility model.

DETAILED DESCRIPTION OF THE PREFERRED EMBODIMENT

Figure 3:
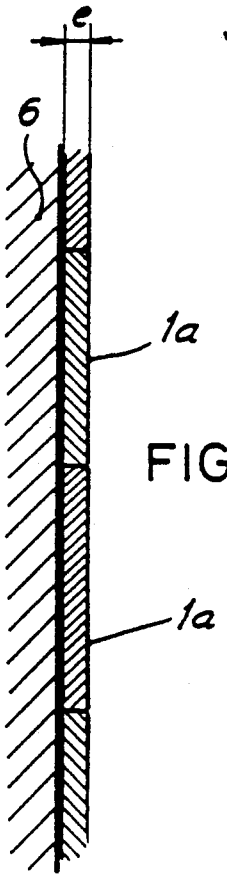
FIG. 3 is a cross section in elevation through cutting line III—III of the aforementioned FIG. 2.

Referring to the drawings in particular (FIG. 1), the tile that is the object of the present invention includes a flat body 1 with an irregular polygonal periphery, like a leaf, with several recesses 2 and various parallel sides opposite one another 3*a*–3*b*, 4*a*–4*b*, and 5*a*–5*b*, such that it can be joined together with others 1*a* (FIG. 2) all with the same orientation and continuously, which would be suitable, for example, for a wall 6. In this case, tile 1*a* will not be very thick (FIG. 3). The tile 1 has eleven (11) sides, with a first side 3*a*, a second side 3*b*, a third side 4*a*, a fourth side 4*b*, a fifth side 5*a*, a sixth side 5*b*, a seventh side 17, an eighth side 15*a*, a ninth side 15*b*, a tenth side 16*a*, and an eleventh side 16*b*.

First and second sides 3*a* and 3*b* are parallel and have the same length. Third and fourth sides 4*a* and 4*b* are parallel and have the same length. The fifth side 5*a*, the sixth side 5*b* and the seventh side 17 are parallel, and the length of the fifth side 5*a* is equal to the length of the sixth side 5*b* plus the length of the seventh side 17. Eighth and ninth sides 15*a* and 15*b* are parallel and have the same length. The tenth and eleventh sides 16*a* and 16*b* are also parallel and have the same length.

The tile also has eleven junctions between the eleven sides. Four of these junctions are recesses 2*a*–2*d* and seven of these junctions are projecting corners 18*a*–18*g*. A first recess in 2*a* is positioned between the eighth side 15*a* and the tenth side 16*a*. A second recess is positioned between the sixth side 5*b* and the third side 4*a*. The third recess is positioned between the ninth side 15*b* and the seventh side 17. The fourth recess is positioned between the second side 3*b* and the eleventh side 16*b*. A first projecting corner 18*a* is positioned between the first side 3*a* and the tenth side 16*a*. The second projecting corner is positioned between the eighth side 15*a* and the fifth side 5*a*. The third projecting corner 18*c* is positioned between the fifth side 5*a* and the fourth side 4*b*. The fourth projecting corner 18*d* is positioned between the fourth side 4*b* and the eleventh side 16*b*. The fifth projecting corner 18*e* is positioned between the second side 3*b* and the seventh side 17. The sixth projecting corner 18*f* is positioned between the ninth side 15*b* and the third side 4*a*. The seventh projecting corner 18*g* is positioned between the sixth side 5*b* and the first side 3*a*.

Figure 5:
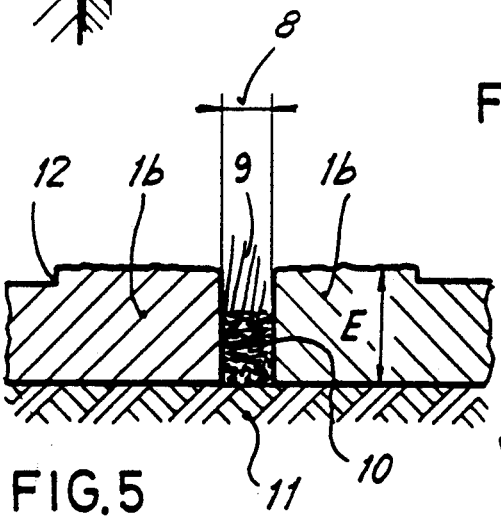
FIG. 5 is a cross section along cutting line V—V of FIG. 4.
Figure 4:
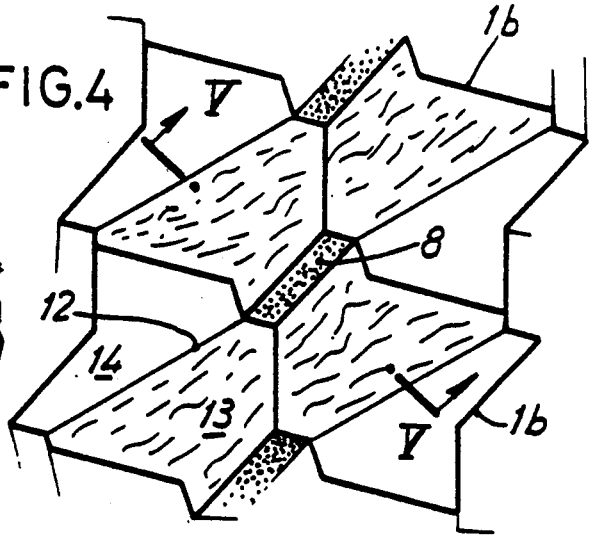
FIG. 4 is another set of the same tiles, but they are arranged with different orientations.

Alternatively, and in the case of paving (FIG. 4), tile 1*b* can be joined with other tiles that are identical, but with different orientations, wherein several side surfaces are adjacent to each other allowing for spaces or openings 8 to protect plants or grass 9 so that they are not flattened down by the pressure of footsteps or traffic (FIG. 5). Observe that in the latter case, tile 1*b* will have a notable thickness E which is calculated such that it will support those pressures as well as provide a depth and a quantity of soil 10 over the bed or mortar 11 that is sufficient to grow grass 8 and to accommodate the same.

Optionally, each piece of tile will be provided with a step in the middle 12 of one of these surfaces 20, 21 that divides it into approximately two halves 13, 14. One of these halves 13 can even be roughened.

Obviously, the halves 13, 14 can have the most appropriate pattern and will be of the most suitable color.

While specific embodiments of the invention have been shown and described in detail to illustrate the application of the principles of the invention, it will be understood that the invention may be embodied otherwise without departing from such principles.

What is claimed is:

1. A tile for arranging in a plurality of patterns, the tile comprising:

a first and second surface opposite each other, a perimeter of said first and second surfaces being defined by a first side, a second side, a third side, a fourth side, a fifth side, a sixth side, a seventh side, an eighth side, a ninth side, a tenth side, and an eleventh side, said first and second sides being parallel, said third and fourth sides being parallel, said fifth and sixth sides being parallel, junctions between said first through eleventh sides forming a first recess, a second recess, a third recess, and a fourth recess.

2. A tile according to claim 1, wherein:

one of said first and second surfaces define a step substantially dividing the tile into two halves.

3. A tile according to claim 2, wherein:

at least one of said halves is provided with an roughened upper surface.

4. A tile in accordance with claim 1, wherein:

said junctions between said first through eleventh sides form seven (7) projecting corners.

5. A tile in accordance with a claim 1, wherein:

said first and second sides are equal in length, said third and fourth sides are equal in length, said eighth and ninth sides are equal in length, said tenth and eleventh sides are equal in length, and length of said fifth side is equal to a length of said sixth side plus a length of said seventh side.

6. A tile in accordance with claim 1, wherein:

said junctions between said first through eleventh sides form a first projecting corner, a second projecting corner, a third projecting corner, a fourth projecting corner, a fifth projecting corner, a sixth projecting corner, and a seventh projecting corner;

said first recess is positioned between said eight side and said tenth side;

said second recess is positioned between said sixth side and said third side;

said third recess is positioned between said ninth side and said seventh side;

said fourth recess is positioned between said second side and said eleventh side;

said first projecting corner is positioned between said first side and said tenth side;

said second projecting corner is positioned between said eight side and said fifth side;

said third projecting corner is positioned between said fifth side and said fourth side;

said fourth projecting corner is positioned between said fourth side and said eleventh side;

said fifth projecting corner is positioned between said second side and said seventh side;

said sixth projecting corner is positioned between said ninth side and said third side;

said seventh projecting corner is positioned between said sixth side and said first side.

7. A tile in accordance with claim 1, wherein:

said plurality of recesses include first through fourth recesses;

said junctions between said first through eleventh sides form first through seventh projecting corners;

a plurality of the tiles can be fitted together by inserting one of said first through seventh projecting corners into one of said first through fourth recess to form a plurality of repeating patterns, one of said plurality of patterns forming a substantially continuous surface, a remainder of said plurality of repeating patterns defining a plurality of free spaces between the tiles, said plurality of free spaces in said remainder of said plurality of patterns repeating in two dimensions.

8. A tile in accordance with claim 7, wherein:

said remainder of said plurality of patterns being selectively preestablished according to which one of said first thought seventh projecting corners are inserted into one of said first through fourth recesses.

9. A tile according to claim 7, wherein:

said free spaces are left on the ground and dimensioned to be thick enough to provide a sufficient amount of soil to grow plants or grass.

* * * * *

UNITED STATES PATENT AND TRADEMARK OFFICE

CERTIFICATE OF CORRECTION

PATENT NO. : 5,333,430

DATED : August 2, 1994

INVENTOR(S) : Francisco Javier Llistosella Vidal

It is certified that error appears in the above-identified patent and that said Letters Patent is hereby corrected as shown below:

On the title page of the above identified patent, please correct the inventor's name as follows:

Item [75] Inventors: Francisco Javier Llistosella Vidal

Signed and Sealed this

Twenty-second Day of November, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,333,430

DATED : August 2, 1994

INVENTOR(S) : Francisco Javier Llistosella Vidal

Figure 1:
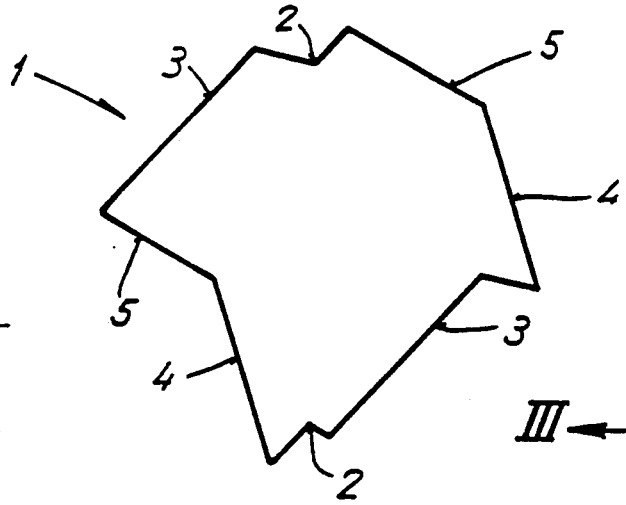
FIG. 1 is a front view of the tile according to the invention.
Figure 2:
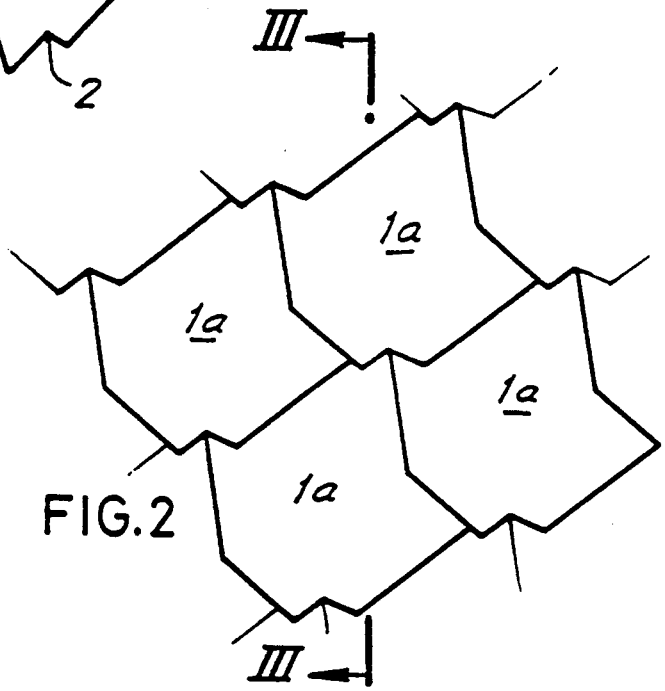
FIG. 2 is a top view showing a continuous set of identical pieces of tile.

It is certified that error appears in the above-indentified patent and that said Letters Patent is hereby corrected as shown below:

In the Drawings:

Figs. 1 and 3 should be deleted and substituted with the attached Figs. 1 and 3.

Signed and Sealed this

Twenty-first Day of May, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,333,430

DATED : August 2, 1994

INVENTOR(S) : Francisco Javier Llistosella Vidal

It is certified that error appears in the above-indentified patent and that said Letters Patent is hereby corrected as shown below:

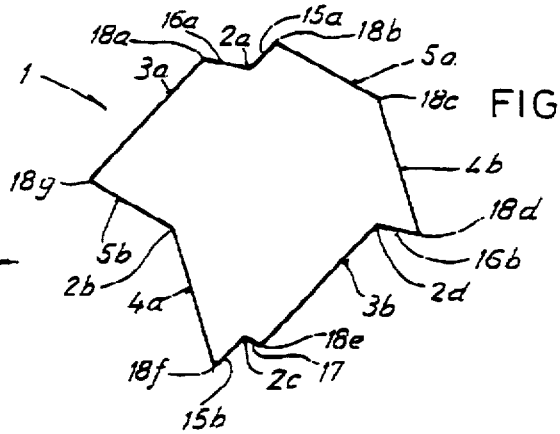

FIG.1

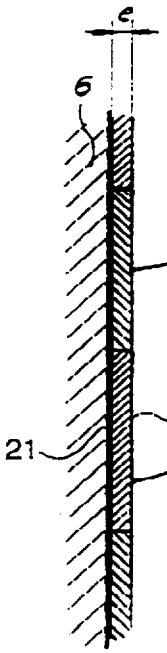

FIG.3

UNITED STATES PATENT AND TRADEMARK OFFICE

CERTIFICATE OF CORRECTION

PATENT NO. : 5,333,430

DATED : August 2, 1994

INVENTOR(S) : Francisco Javier Llistosella Vidal

It is certified that error appears in the above-indentified patent and that said Letters Patent is hereby corrected as shown below:

In the Drawings:

Figs. 1 and 3 should be deleted and substituted with the attached Figs. 1 and 3.

Signed and Sealed this

Second Day of July, 1996

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,333,430

DATED : August 2, 1994

INVENTOR(S) : Francisco Javier Llistosella Vidal

It is certified that error appears in the above-indentified patent and that said Letters Patent is hereby corrected as shown below:

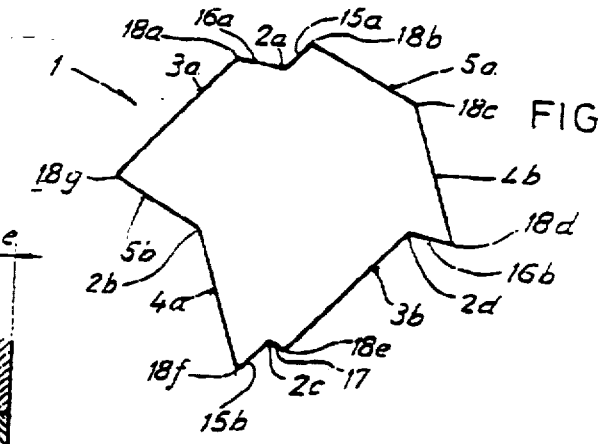

FIG.1

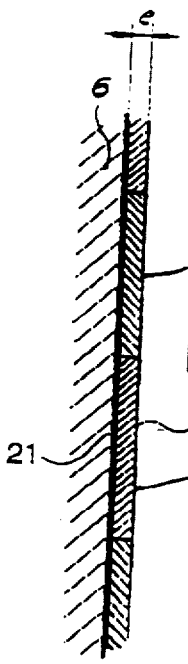

FIG.3